US009743737B1

(12) United States Patent
Malbrough

(10) Patent No.: US 9,743,737 B1
(45) Date of Patent: Aug. 29, 2017

(54) UNIVERSAL HAIR SCENT DIFFUSER

(71) Applicant: La Sonya D. Malbrough, Tampa, FL (US)

(72) Inventor: La Sonya D. Malbrough, Tampa, FL (US)

( * ) Notice: Subject to any disclaimer, the term of this patent is extended or adjusted under 35 U.S.C. 154(b) by 275 days.

(21) Appl. No.: 14/756,009

(22) Filed: Jul. 20, 2015

(51) Int. Cl.

| | |
|---|---|
| ***A45D 20/12*** | (2006.01) |
| ***A45D 20/10*** | (2006.01) |
| ***A45D 20/08*** | (2006.01) |
| *A45D 20/22* | (2006.01) |
| *A45D 20/04* | (2006.01) |
| *A45D 20/20* | (2006.01) |

(52) U.S. Cl.
CPC ..... *A45D 20/122* (2013.01); *A45D 20/08* (2013.01); *A45D 20/10* (2013.01); *A45D 20/12* (2013.01); *A45D 20/04* (2013.01); *A45D 20/20* (2013.01); *A45D 20/22* (2013.01)

(58) Field of Classification Search
CPC ..... A45D 20/10; A45D 20/20; A45D 20/22; A45D 20/122; A45D 20/04; F16L 47/18; F16L 37/00; Y10T 403/7015; Y10T 16/5362
USPC ..... 34/96, 97, 98, 390, 283; 132/108–116, 132/271; 395/396; 403/91; 16/221
See application file for complete search history.

(56) References Cited

U.S. PATENT DOCUMENTS 4,605,019 A * 8/1986 Reynolds ..... A45D 20/12 132/272
5,572,800 A * 11/1996 West ..... A61L 9/03 34/390
5,966,833 A * 10/1999 Andis ..... A45D 20/122 34/283
5,987,771 A * 11/1999 Curtin ..... A45D 34/00 34/97
8,407,913 B2 * 4/2013 Langley ..... A45D 19/16 132/271

* cited by examiner

*Primary Examiner* — Kenneth Rinehart
*Assistant Examiner* — Raymond Williamson
(74) *Attorney, Agent, or Firm* — Hugh B. Thompson, II

(57) ABSTRACT

A universal hair scent diffuser having a hollow upper body hingedly affixed to a lower body, the upper body having an open end that houses an interior lining therein made of heat resistant elastomeric material, wherein the lining is graduated at the open end to facilitate a press fit connection to a barrel end of a conventional hand hair dryer. The lower body houses a wire mesh that receives a scented disc thereon. The upper body has a wire mesh located at a lower open end. The scented sheet is placed between both wire meshes when the upper body and lower body are in a latch position. The diffuser is then fitted on the barrel end. The user may then turn on the hair dryer to the desired fan and heat levels and the sheet is vaporized providing a pleasant and refreshing aromatic scent onto the user's hair.

17 Claims, 8 Drawing Sheets

UNIVERSAL HAIR SCENT DIFFUSER

FIELD OF THE INVENTION

This invention generally relates to a scented universal hair diffuser. More specifically, the invention pertains to an apparatus which can be removably attached to a conventional hair diffuser head and houses an aroma disc/sheet therein that disperses a selected scent when attached to and acted upon by a hot air stream from a conventional hand held hair dryer.

BACKGROUND OF THE INVENTION

The Field of the Invention

The present invention is drawn to hair diffuser that is removably attached to a conventional hand held hair dryer and houses a means for providing a scented fragrance onto a user's hair when the hair dryer is in use.

It is common for hair diffusers to come in a variety of shapes, lengths, and have multiple attachments means for securing to the end of a conventional hand hair dryer. For example, the diffuser may be press fitted, screwed, or even secured to an end of the hair dryer by use of hook and loop fastener. In addition, some diffusers are also capable of discharging a fragrance to a user's hair. For example, when a hair diffuser is secured to a hair dryer by any appropriate means, the hair dryer may then be used in a manner that allows the hot air of the dryer to come in contact with scented discs or other means for providing a fragrance, thus "diffusing" or vaporizing the desired fragrance or scent onto the hair of the user.

There have been attempts to ensure that these type of hair diffusers are efficient at diffusing hot air and fragrances in a manner that reduces the likelihood of the loss of hot air at diffuser attachment locations, as well as increasing the life of the scented disc or sheet. However, there still exists a need for an apparatus that is capable of providing the utility of all of the aforementioned elements of a hair diffuser.

Description of Related Art

An examination of the prior art of record discloses various types of hair diffusers and hand held hair dryer attachments. U.S. Pat. No. 5,241,974 to Tsai (herein "Tsai-974"), discloses a hair appliance for directing warm air to hair. The hair dryer 1 is comprised of air concentrator 2 that is snap or press fitted onto barrel 10 of the hair dryer. A reservoir 30 is attached external of air concentrator 2 and can be filled with a liquid 301 that through capillary action can be absorbed onto a liquid permeable member 34. Member 34 is fireproof cotton and is housed within the air concentrator 2, such that when in contact with hot air generated within barrel 10, the member 34 is evaporated therein. The now evaporated liquid 301 is entrained within the hot air stream and can be applied onto hair of a user for multiple purposes. There is also a heat insulating member 322 that is used to prevent reservoir 30 from being damaged as a result of high temperatures generated by use of the hair dryer. Tsai-974 fails to disclose an easily accessible housing for the member 34 that is within the air concentrator itself located at the interface of the air concentrator 2 and the barrel 10, this allowing for maximum heat efficiency of the dryer, as well as a means for lengthening the life of member 34.

U.S. Pat. No. 5,572,800 to West (herein "West-800"), discloses an air freshening attachment for hair dryers. The diffuser attachment 12 is securably attached to conventional hair dryer 10 by means of tapered interior 24 of body section 20 of attachment 12, thus allowing for attachment to dryer barrels having multiple configurations and sizes. Fragrance elements 40 and 50 are adapted to be placed within attachment 12 such that when the hot air stream from dryer 10 comes in contact with the fragrance elements 40, 50, vaporizing freshening material 48 of elements 40, 50 is vaporized releasing a scent into the air stream for application onto a user's hair. West-800 fails to disclose a simple fragrance element that is relatively thin and comprised of a single disc or wafer, nor discloses a means for ensuring maximum heating efficiency of the unit while providing a simple securable connection of the attachment to the dryer.

U.S. Pat. No. 5,649,370 to Russo (herein "Russo-370"), discloses a delivery system diffuser attachment 12 for a hair dryer 14. A cup member 34 of diffuser attachment 12 is secured to barrel 22 of dryer 14 by a retaining structure 40 having a shaft 58 one end of which is secured to cup member 34 and the other end of which is secured to strap 60, the ends of strap 60 being securable together by hook and loop fastener around end 42 of barrel 22. The interior compartment 54 of attachment 12 has a holding assembly 44. Assembly 44 is attached to member 34 by attaching element 70, 80 and has small container 68 comprised of a perforated box 72, 76. Box 72, 76 has a perforated lid 78 that is hinged thereto. The box can contain a scented particulate material or a gel/cream therein that can vaporize when in contact from a hot air stream generated from dryer 14. Russo-370 fails to disclose a less cumbersome means of attaching the diffuser to the hair dryer, but more importantly, fails to disclose scented material that is without residue, such as a gel or cream and is completely subject to the force of the entire hot air stream, thus allowing for complete and even distribution of the vaporized scented material.

US Patent Application Publication No. US 2013/0025106 A1 to Hernandez-Laines (herein "Laines-106"), discloses a retention mechanism for retaining a concentrator nozzle 16 to a hair dryer 10 to prevent the nozzle from inadvertently detaching from the dryer during operation. Dryer 10 can be rotatably secured to nozzle 16 by button receiving portions 18 engaging therewith buttons 12 of dryer 10. In addition, heat resistant elastomeric member 40 can be inserted between the nozzle and dryer at the connection point to aid in the retention of the two components to each other. Laines-106 fails to disclose a simple connection between the diffuser and dryer without special added structure, i.e., "buttons" that works with hair dryers of various circumferences.

None of the aforementioned prior art of record addresses the utility of a universal hair diffuser attachable to conventional hair dryers having a means for providing a scented fragrance onto a user's hair when the hair dryer is in use, while providing a simple and easy means of accessing or replacing the scented material and maximizing heating efficiency of the hair dryer as it vaporizes the scented material. Herein lays the novel aspects of the instant invention that will be discussed in detail.

SUMMARY OF THE INVENTION

The present invention provides a simple and efficient means for attaching a universal hair scent diffuser to a conventional hand held hair dryer, i.e., hand blow dryer, the diffuser also housing an aromatic or scented disc or sheet that can be easily replaced or removed as necessary. The preferred embodiment of the universal hair scent diffuser comprises a hollow upper body having an open end housing an interior lining therein made of rubber or other appropriate heat resistant elastomeric material, wherein the lining is graduated in structure at the open end to facilitate a press fit or similar type connection to a barrel end of a conventional hand hair dryer. The upper body open end is preferably cylindrical but can be fabricated to accommodate hand held dryer barrel ends of varying shapes and lengths. The upper body has a lower end opposite the open end. The upper body lower end has an interior annular groove about the interior surface therein for receipt of a heat resistant elastomeric gasket/seal member such as an O-ring. Just above the interior groove is a wire mesh secured to and extending across the interior diameter of the upper body lower end.

Depending from the annular groove at opposed sides of the upper body lower end are slots/recesses adapted to receive a corresponding L-shaped flexible tab and L-shaped hinge insert, respectively. The flexible tab and hinge insert extend upward from opposed exterior edges of a hollow lower body. When so aligned, the flexible tab and hinge insert of the lower body are adapted to be received within the opposed slots/recesses of the upper body lower end such that when the flexible tab is disengaged from its slot and the hinge insert is received within its corresponding slot, the upper body and lower body are pivotally connected to one another and the hinge insert, now in its mating slot, provides a hinge connection between the upper body and lower body. The upper portion of the lower body is preferably the same shape and width of the lower end of the upper body such that the two ends provide a seamless cylindrical (preferred shape) connection between the upper body and lower body when the flexible tab is received within its slot in a latch or closed position. The upper portion of the lower body also has an interior annular groove about an interior surface therein for receipt of a heat resistant elastomeric gasket/seal member such as an O-ring. Just below the interior groove is a wire mesh secured to and extending across the interior diameter of the upper portion of the lower body.

An aromatic or scented disc/sheet that is non-flammable or heat resistant, is adapted to be placed between both wire meshes, such that when the upper body and lower body are in the latch or closed position, the space between the wire meshes is preferably no more than a few millimeters. The lower body may also flare downward to a desired embodiment of a diffuser shape. The shapes may include a cone shape, a comb shape having teeth, a circular diffuser with teeth or an accordion shape that flares out to a larger circular diameter than that of the upper portion of the lower body. The lower body may also have a perforated base portion that allows for even distribution of hot airflow prior to engagement with a user's hair.

In the preferred embodiment, the universal hair scent diffuser is used with a conventional hand hair dryer that is not required for the instant invention, as it is an accessory thereto. The hair dryer ideally has a handle with a power switch and a barrel section through which a fan blows air over a heating element that is discharged through the end of the barrel section, such that a means for heating the scented sheet and a means for heating discharged air is provided. Fan speeds, as well as heating levels, are all adjustable to a user's desired levels in a now use condition. Prior to attachment to the hair dryer, a user may open up the upper body and lower body relative to one another and place the scented disc on the wire mesh of the lower body. The upper and lower body may then be snap closed on side to form a seamless cylindrical unit. The universal hair scent diffuser is then fitted over and onto the end of the barrel section such that there is a tight fit or connection. The user may then turn on the hair dryer to the desired fan and heat levels in the use condition. In the use condition, the warm air generated by the hand held dryer is directed through the diffuser engages the scented disc and then vaporizes scented material on the disc and discharges the now scented air through the lower body. The user may now enjoy a pleasant and refreshing aromatic scent in his or her hair as the dryer is used in a normal manner.

There are several preferred dimensions of the instant invention, though not limiting in any way. The upper body is preferably three inches in length and the lower body is 2.75" in height. Teeth depending from the base portion are preferably 1.5" in height. In addition, the present invention can be made from a combination of polymeric materials having a high resistance to heat.

LIST OF REFERENCE CHARACTERS

| | |
|---|---|
| 1. Hollow upper body | 12. Vertical tab arm |
| 2. Hollow lower body | 13. Tab slot/recess |
| 3. Teeth | 14. Hinge slot/recess |
| 4. Graduated rubber lining | 15. Cone shaped lower body |
| 5. Perforated lower body base | 16. Comb shaped lower body |
| 6. Scented disc/sheet | 17. Comb teeth |
| 7. 0-ring/elastomeric material | 18. Accordion shaped lower body |
| 8. Interior annular groove | 19. Upper body open end |
| 9. Wire mesh | 20. Upper body lower end |
| 10. L-shaped Flexible tab | 21. Upper portion of lower body |
| 11. L-shaped hinge insert | |

DETAILED DESCRIPTION OF THE PREFERRED EMBODIMENT

Figure 1:
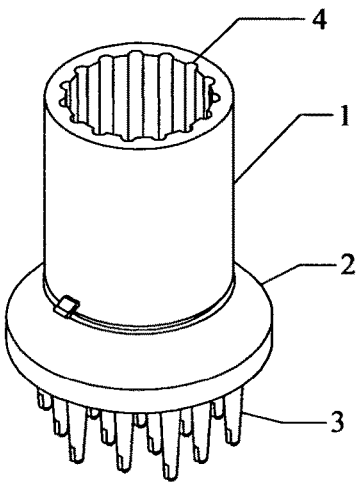
FIG. 1 is a side view of the Universal hair scent diffuser preferred embodiment in a closed use position.
Figure 2:
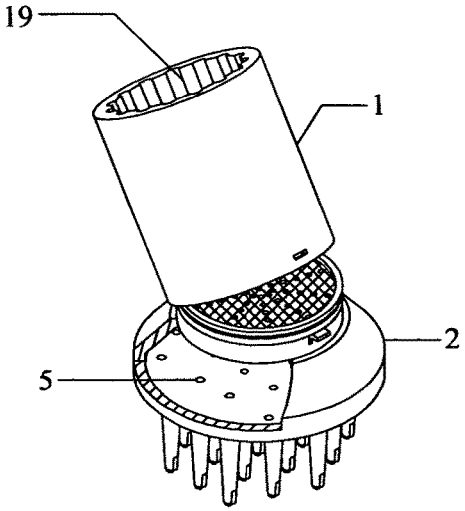
FIG. 2 is a side view of the Universal hair scent diffuser preferred embodiment in a partially open non-use position, with a cut away showing the perforated lower body base.
Figure 3:
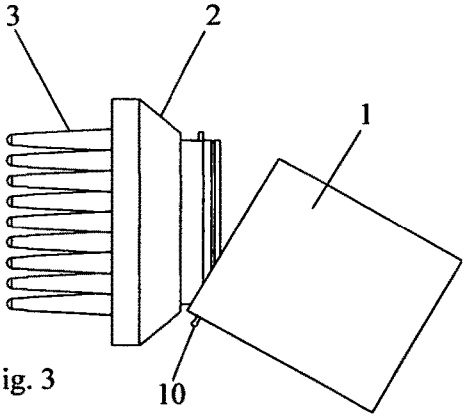
FIG. 3 is a side view of the Universal hair scent diffuser preferred embodiment in a partially open non-use condition.
Figure 4:
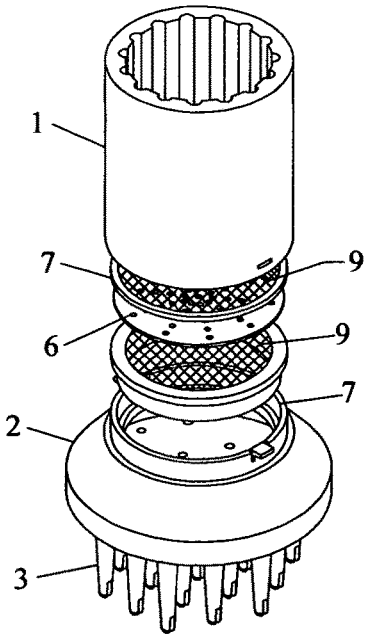
FIG. 4 is a side view of the Universal hair scent diffuser preferred embodiment in an upright extended lifted open non-use condition.
Figure 5:
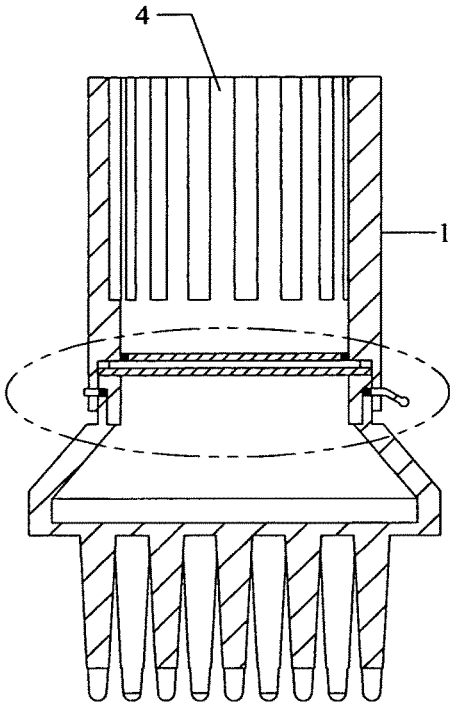
FIG. 5 is a cross section of the Universal hair scent diffuser preferred embodiment in a closed use condition.
Figure 6:
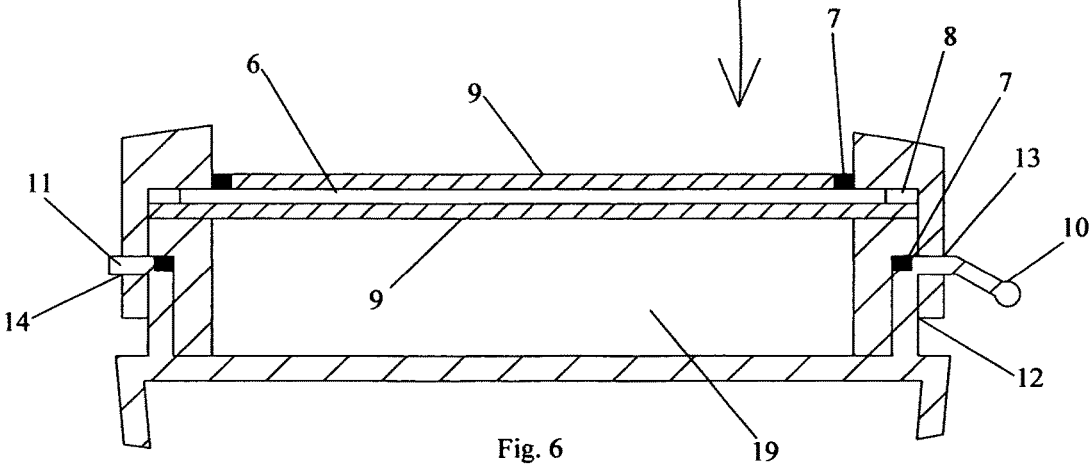
FIG. 6 is an exploded cross section of the Universal hair scent diffuser preferred embodiment at the hinge connection.
Figure 7:
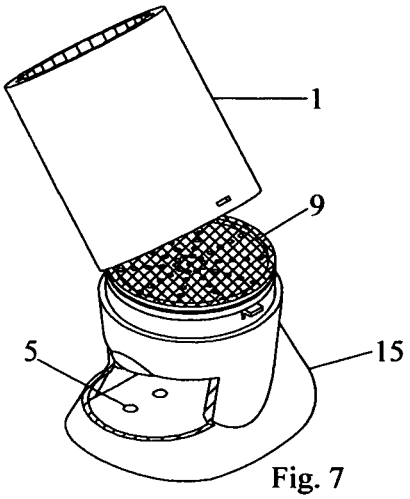
FIG. 7 is a side view of the Universal hair scent diffuser cone shaped embodiment in a partially open non-use position, with a cut away showing the perforated lower body base.
Figure 8:
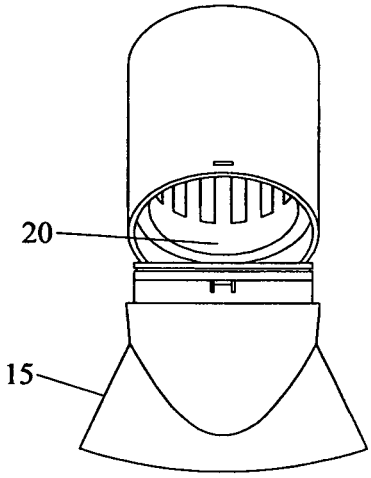
FIG. 8 is a front view of the Universal hair scent diffuser cone shaped embodiment in a partially open non-use position.
Figure 9:
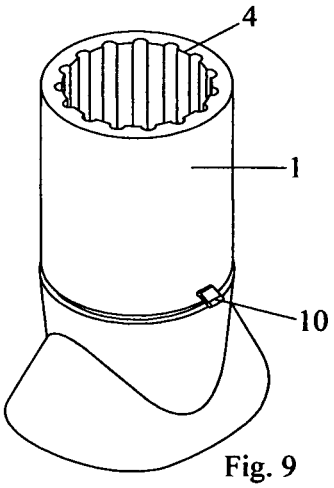
FIG. 9 is a side view of the Universal hair scent diffuser cone embodiment in a closed use position.
Figure 10:
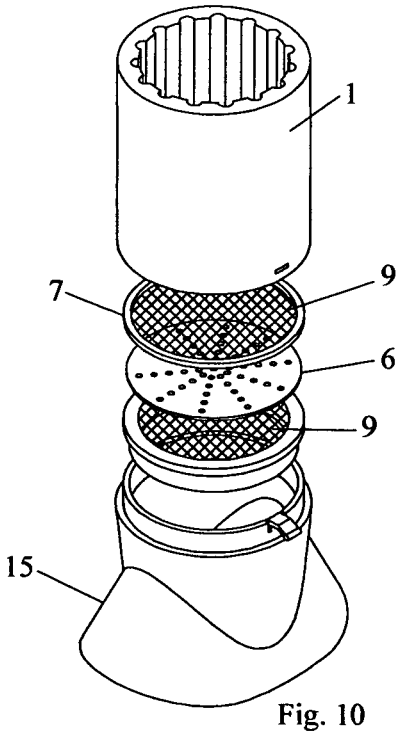
FIG. 10 is a side view of the Universal hair scent diffuser cone embodiment in an upright extended lifted open non-use condition.

FIGS. 1-4 are an illustration of the preferred embodiment of the Universal hair scent diffuser. FIG. 1 is a side view of the Universal hair scent diffuser in a closed use position. The diffuser comprises a hollow upper body 1 having and open end 19 housing an interior lining 4, wherein the lining 4 is graduated in structure or tapered along an elongated axis at the open end 19 to facilitate a press fit or similar type connection to a barrel end of a conventional hand hair dryer (not shown). The upper body open end 19 is cylindrical and can accommodate hand held dryer barrel ends of varying shapes and lengths. The upper body 1 has a lower end 20 opposite the open end 19. The upper body lower end 20 has an interior annular groove 8 about the interior surface therein for receipt of a heat resistant elastomeric gasket/seal 7 member such as an O-ring. Just above the interior groove 8 is a wire mesh 9 secured to and extending across the interior diameter of the upper body lower end 20. The wire mesh 9 of the upper body member can be secured to interior diameter of the upper body lower end 20 by any appropriate means such as a press fit within interior grooves of the upper body lower end 20, or snap fitted into annular ridge within the upper body lower end (not shown) so as to be removably attachable within the upper body lower end 20. FIG. 2 is a side view of the Universal hair scent diffuser in a partially open non-use position, with a cut away showing the perforated lower body base 2. FIG. 3 is a side view of the Universal hair scent diffuser in a partially open non-use condition. Depending from the annular groove 8 at opposed sides of the upper body lower end 20 are slots/recesses 13, 14 adapted to receive a corresponding L-shaped flexible tab 10 and L-shaped hinge insert 11, respectively. The flexible tab 10 and hinge insert 11 extend upward from opposed exterior edges of lower body 2. When so aligned, the flexible tab 10 and hinge insert 11 of the lower body 2 adapted to be received within the opposed slots/recesses 13, 14 of the upper body lower end 20 such that when the flexible tab 10 is disengaged from its slot 13 and the hinge insert 11 is received within its corresponding slot 14 the upper body 1 and lower body 2 are pivotally connected to one another and the hinge insert 11, now in its mating slot 14, provides a hinge connection between the upper body 1 and lower body 2. The upper portion of the lower body 21 is preferably the same shape and width of the lower end 20 of the upper body such that the two ends provide a seamless cylindrical connection between the upper body 1 and lower body 2 when the flexible tab 10 is received within its slot 13 in a latch or closed position.

Figure 11:
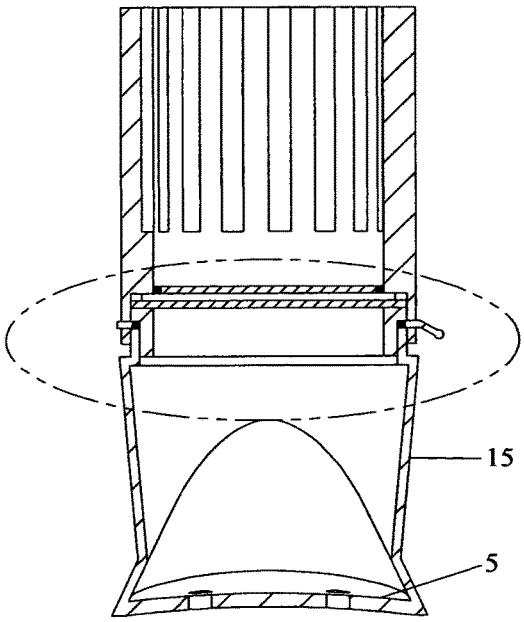
FIG. 11 is a cross section of the Universal hair scent diffuser cone embodiment in a closed use condition.
Figure 12:
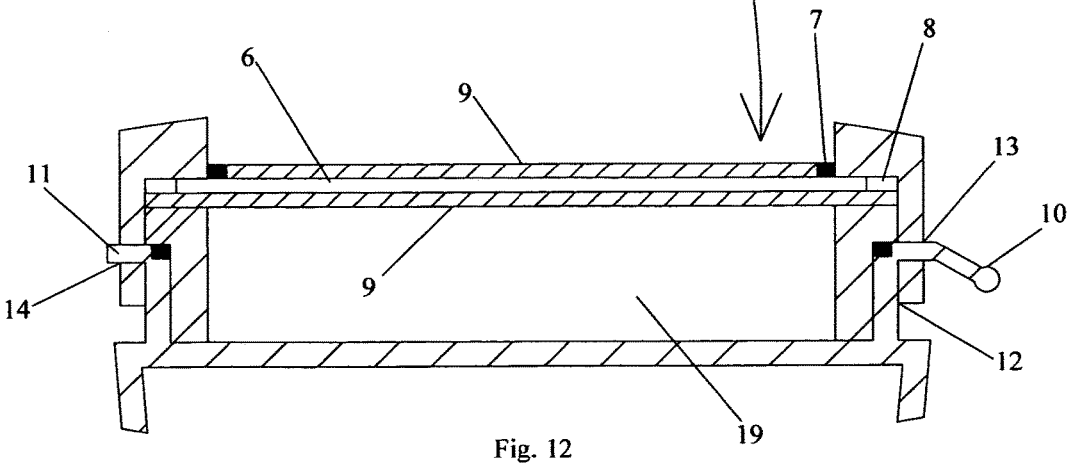
FIG. 12 is an exploded cross section of the Universal hair scent diffuser cone embodiment at the hinge connection.
Figure 13:
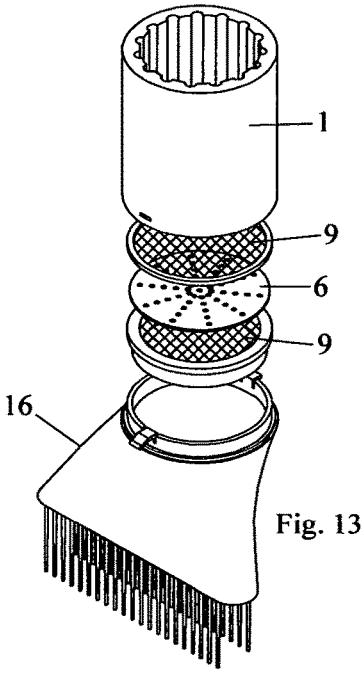
FIG. 13 is a side view of the Universal hair scent diffuser comb embodiment in an upright extended lifted open non-use condition.
Figure 14:
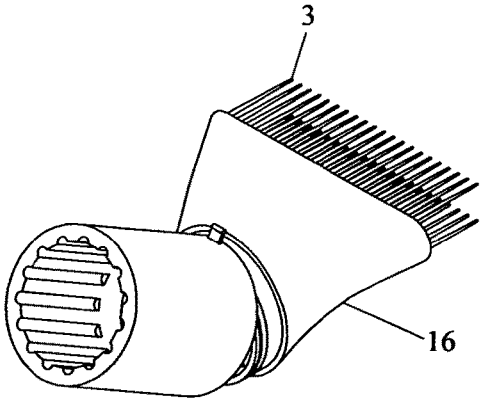
FIG. 14 is a plan view of the Universal hair scent diffuser comb embodiment in a partially open non-use condition.
Figure 15:
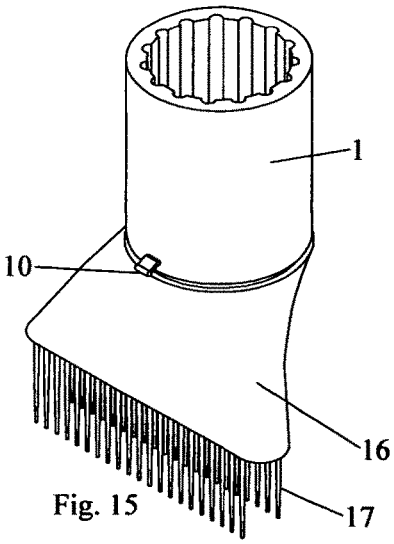
FIG. 15 is a side view of the Universal hair scent diffuser comb embodiment in a closed use position.
Figure 16:
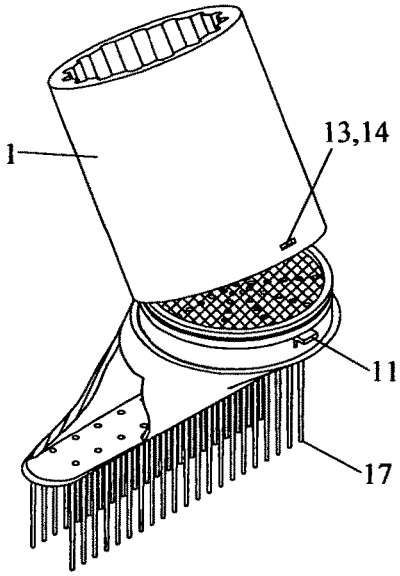
FIG. 16 is a side view of the Universal hair scent diffuser comb embodiment in a partially open non-use position, with a cut away showing the perforated lower body base.
Figure 17:
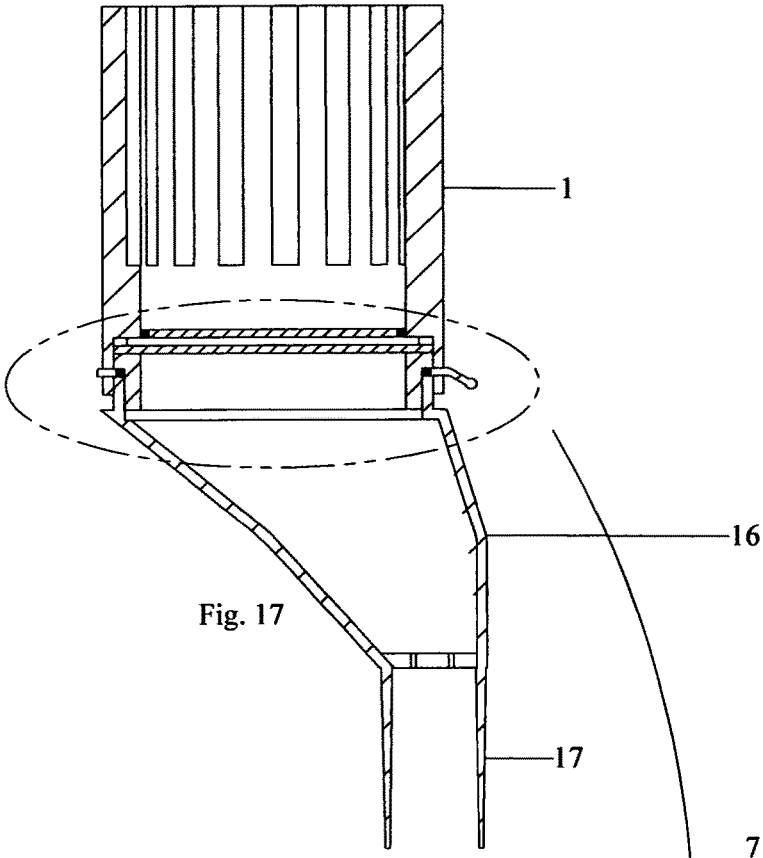
FIG. 17 is a cross section of the Universal hair scent diffuser comb embodiment in a closed use condition.
Figure 18:
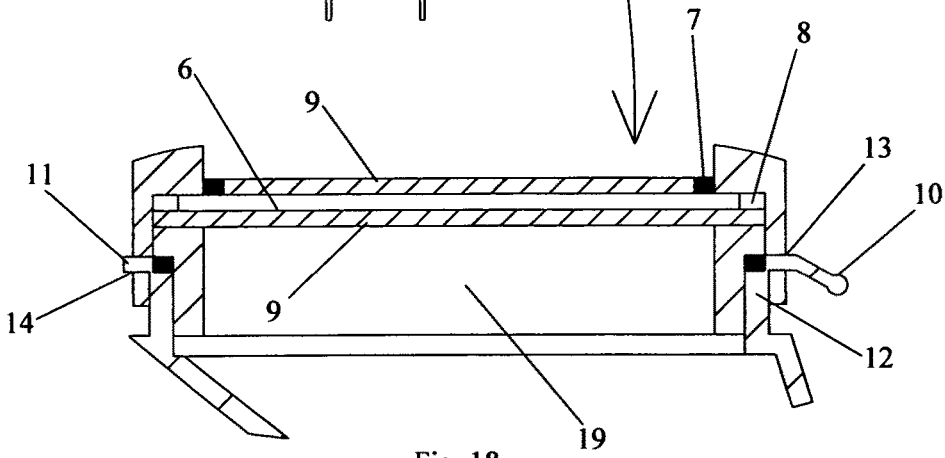
FIG. 18 is an exploded cross section of the Universal hair scent diffuser comb embodiment at the hinge connection.

FIGS. 7-10 show the diffuser having a cone shaped lower body 15. Other than the shape of the lower body 15, the remaining structure is identical to the preferred embodiment shown in FIGS. 1-4. Though shown with perforations in FIGS. 7 and 11, the cone shaped lower body 15 can be completely hollow and open throughout.

FIGS. 13-16 show the diffuser having a comb shaped lower body 16. Other than the shape of the lower body 16, the remaining structure is identical to the preferred embodiment shown in FIGS. 1-4.

Figure 19:
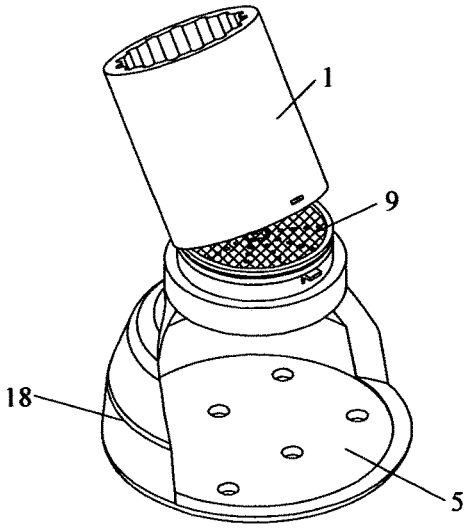
FIG. 19 is a side view of the Universal hair scent diffuser accordion embodiment in an open non-use position, with a cut away showing the perforated lower body base.
Figure 20:
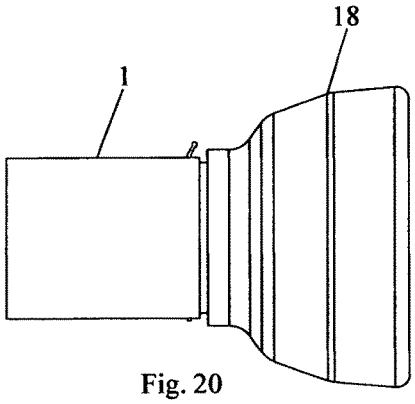
FIG. 20 is a side view of the Universal hair scent diffuser accordion embodiment in a closed use position.
Figure 21:
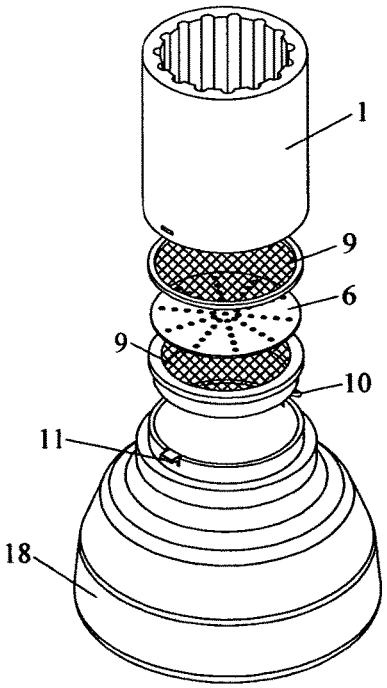
FIG. 21 is a side view of the Universal hair scent diffuser accordion embodiment in an upright extended lifted open non-use condition.
Figure 22:
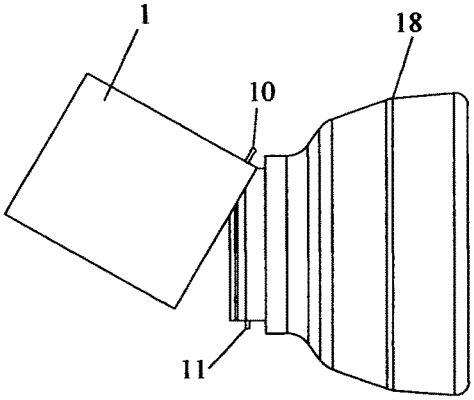
FIG. 22 is a side view of the Universal hair scent diffuser accordion embodiment in a partially open non-use condition.
Figure 23:
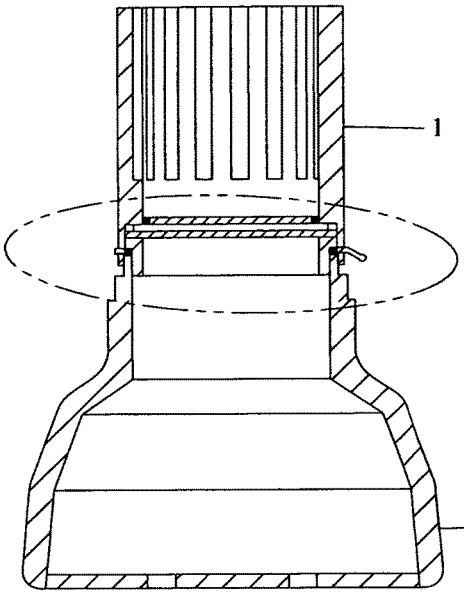
FIG. 23 is a cross section of the Universal hair scent diffuser accordion embodiment in a closed use condition.
Figure 24:
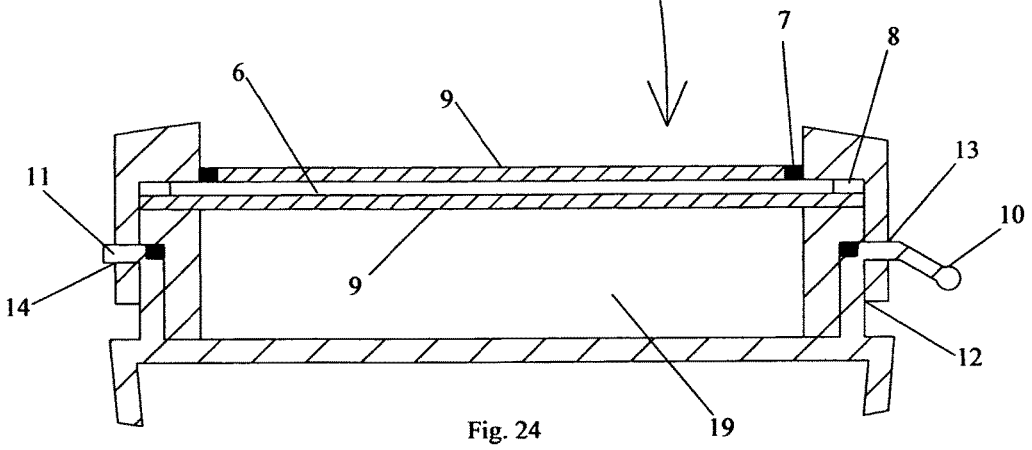
FIG. 24 is an exploded cross section of the Universal hair scent diffuser accordion embodiment at the hinge connection.

FIGS. 19-22 show the diffuser having an accordion shaped lower body 18. Other than the shape of the lower body 18, the remaining structure is identical to the preferred embodiment shown in FIGS. 1-4. FIG. 19 shows the accordion shaped lower body 18 with a perforated base 5. There is no structural requirement, however, for a perforated base 5 in this embodiment. Lower body 18 may have structure similar to teeth 3 of as shown in FIGS. 1-4.

FIGS. 5, 11, 17, and 23 all show cross sections of the Universal hair scent diffuser for the preferred embodiment, cone shaped lower body 15, comb shaped lower body 16, and accordion shaped lower body 18, respectively, in a closed use condition.

FIGS. 6, 12, 18, and 24 all show an exploded cross section view of the Universal hair scent diffuser at the hinge connection. Wire meshes 9 are located on either side of scented disc/sheet 6. O-ring 7 is located within groove 8 and slots 13 and 14 receive L-shaped flexible tab 10 and hinge insert 11, respectively. When so aligned, the flexible tab 10 and hinge insert 11 of the lower body 2 are adapted to be received within the opposed slots/recesses 13, 14 of the upper body lower end 20 such that when the flexible tab 10 is disengaged from its slot and the hinge insert 11 is received within its corresponding slot, the upper body 1 and lower body 2 are pivotally connected to one another and the hinge insert 11, now in its mating slot, provides a hinge connection between the upper body 1 and lower body 2.

A more detailed description of the Universal hair scent diffuser will now be described. In use, the universal hair scent diffuser is used with a conventional hand hair dryer (not shown). The hair dryer ideally has a handle with a power switch and a barrel section through which a fan blows air over a heating element that is discharged through the end of the barrel section. Fan speeds, as well as heating levels, are all adjustable to a user's desired levels. Prior to attachment to the hair dryer, a user may open up the upper body 1 and lower body 2 relative to one another such that the upper body pivots away from the lower body, and a user thereof can place the scented disc 6 on the wire mesh 9 of the lower body 2. The upper and lower body 1, 2 are then snap closed together to form a seamless cylindrical unit. The universal hair scent diffuser is then fitted over and onto the end of the barrel section such that there is a tight fit or connection. The user may then turn on the hair dryer to the desired fan and heat levels. The user may now enjoy a pleasant and refreshing aromatic scent in his or her hair as the dryer is used in a normal manner.

The above embodiments of the instant invention have been presented so as to not limit the invention to only those embodiments. For example, the diffuser may be manufactured using 3d printing versus molded or extruded fabrication techniques. The diffuser may be made of rigid elastomeric material as well as by using sintering powder. It is contemplated that obvious variations, modifications, and improvements are within the skill of one familiar to relevant arts.

What is claimed is:

1. A hair diffuser comprising:

a hollow upper body having an open end housing an interior elongated lining therein made of a heat resistant elastomeric material, wherein the lining is tapered along its elongated axis at the open end and is adapted to facilitate a press fit connection to a barrel end of a hand hair dryer in a use condition;

the upper body having a lower end opposite the open end, and an interior annular groove about an interior surface therein for receipt of a heat resistant flexible elastomeric seal member and located above the interior groove is a wire mesh secured to and extending across an interior diameter of the upper body lower end;

the annular groove having at opposed sides of the upper body lower end and depending therefrom, slots adapted to receive a corresponding L-shaped flexible tab and L-shaped hinge insert, respectively, the flexible tab and the hinge insert extending upward from opposed exterior edges of a hollow lower body, and when so aligned, the flexible tab and the hinge insert of the lower body are adapted to be received within the opposed slots of the upper body lower end such that when the flexible tab is disengaged from its slot and the hinge insert is received within its corresponding slot, the upper body and lower body are pivotally connected to one another and the hinge insert, now in its corresponding slot, providing a hinge connection between the upper body and lower body; and wherein an upper portion of the lower body has the same shape and width of the lower end of the upper body such that the two ends provide a seamless connection between the upper body and lower body when the flexible tab is received within its slot in a closed position, and the upper portion of the lower body also having an interior annular groove about an interior surface therein for receipt of a heat resistant flexible elastomeric seal member, and just below the interior groove of the lower body is a wire mesh secured to and extending across an interior diameter of the upper portion of the lower body.

2. The diffuser claim 1, wherein a scented sheet of flexible, heat resistant material, is adapted to be placed between the respective wire meshes of the upper body and the lower body in the closed position, such that when the upper body and lower body are in the closed position, and the diffuser has been attached to the barrel end of the hand held dryer in the use condition, the scented sheet is adapted to be vaporized as warm air is blown from the hand held dryer in the use condition through the diffuser that is adapted to be attached thereto.

3. The diffuser of claim 1, wherein the barrel end is circular in shape.

4. The diffuser of claim 2, wherein the barrel end is circular in shape.

5. The diffuser of claim 1 wherein the upper body and lower body are made of a rigid heat resistant elastomeric material.

6. The diffuser of claim 1, wherein a scented sheet of flexible, heat resistant material, is adapted to be placed between the respective wire meshes of the upper body and the lower body in the closed position, such that when the upper body and lower body are in the closed position a means for heating the scented sheet is provided such that warm air generated by the hand held dryer is adapted to be directed through the diffuser, engage the scented sheet, and then vaporize scented material on the sheet so that the now scented air is discharged through the lower body.

7. The diffuser of claim 1, wherein the lower body is comb shaped.

8. The diffuser of claim 1, wherein the lower body is cone shaped.

9. A hair diffuser comprising:

a hollow upper body having an open end housing an interior elongated lining therein made of a heat resistant elastomeric material, wherein the lining is tapered along its elongated axis at the open end and is adapted to facilitate a press fit connection to a barrel end of a hand hair dryer in a use condition;

the upper body having a lower end opposite the open end, and an interior annular groove about an interior surface therein for receipt of a heat resistant flexible elastomeric seal member and located above the interior groove is a wire mesh secured to and extending across an interior diameter of the upper body lower end;

the annular groove having at opposed sides of the upper body lower end and depending therefrom, slots adapted to receive a corresponding L-shaped flexible tab and L-shaped hinge insert, respectively, the flexible tab and the hinge insert extending upward from opposed exterior edges of a hollow lower body, and when so aligned, the flexible tab and the hinge insert of the lower body are adapted to be received within the opposed slots of the upper body lower end such that when the flexible tab is disengaged from its slot and the hinge insert is received within its corresponding slot, the upper body and lower body are pivotally connected to one another and the hinge insert, now in its corresponding slot, providing a hinge connection between the upper body and lower body;

the upper portion of the lower body is has the same shape and width of the lower end of the upper body such that the two ends provide a seamless connection between the upper body and lower body when the flexible tab is received within its slot in a closed position, and the upper portion of the lower body also having an interior annular groove about an interior surface therein for receipt of a heat resistant flexible elastomeric seal member, and just below the interior groove of the lower body is a wire mesh secured to and extending across an interior diameter of the upper portion of the lower body; and wherein a scented sheet of flexible, heat resistant material, is adapted to be placed between the respective wire meshes of the upper body and the lower body in the closed position, such that when the upper body and lower body are in the closed position a means for heating the scented sheet is provided such that warm air generated by the hand held dryer is adapted to be directed through the diffuser, engage the scented sheet, and then vaporize scented material on the sheet so that the now scented air is discharged through the lower body.

10. The diffuser of claim 9, wherein the barrel end is circular in shape.

11. The diffuser of claim 9, wherein the upper body and lower body are made of a rigid heat resistant elastomeric material.

12. The diffuser of claim 9, wherein the lower body is comb shaped.

13. The diffuser of claim 9, wherein the lower body is accordion shaped.

14. The diffuser of claim 9, wherein the lower body is cone shaped.

15. In combination a hair diffuser and hand held dryer, the combination comprising:

a hand held dryer having a handle with a power switch and a barrel end through which a fan blows air over a heating element that is discharged through the barrel end, such that a means for heating discharged air is provided;

a hollow upper body having an open end housing an interior elongated lining therein made of a heat resistant elastomeric material, wherein the lining is tapered along its elongated axis at the open end and is adapted to facilitate a press fit connection to a barrel end of the hand held hair dryer in a use condition;

the upper body having a lower end opposite the open end, and an interior annular groove about an interior surface therein for receipt of a heat resistant flexible elastomeric seal member and located above the interior groove is a wire mesh secured to and extending across an interior diameter of the upper body lower end;

the annular groove having at opposed sides of the upper body lower end and depending therefrom, slots adapted to receive a corresponding L-shaped flexible tab and L-shaped hinge insert, respectively, the flexible tab and the hinge insert extending upward from opposed exterior edges of a hollow lower body, and when so aligned, the flexible tab and the hinge insert of the lower body are adapted to be received within the opposed slots of the upper body lower end such that when the flexible tab is disengaged from its slot and the hinge insert is received within its corresponding slot, the upper body and lower body are pivotally connected to one another and the hinge insert, now in its corresponding slot, providing a hinge connection between the upper body and lower body; and wherein the upper portion of the lower body is has the same shape and width of the lower end of the upper body such that the two ends provide a seamless connection between the upper body and lower body when the flexible tab is received within its slot in a closed position, and the upper portion of the lower body also having an interior annular groove about an interior surface therein for receipt of a heat resistant flexible elastomeric seal member, and just below the interior groove of the lower body is a wire mesh secured to and extending across an interior diameter of the upper portion of the lower body.

16. The combination of claim 15, wherein, a scented sheet of flexible, heat resistant material, is adapted to be placed between the respective wire meshes of the upper body and the lower body in the closed position, such that when the upper body and lower body are in the closed position, and the diffuser has been attached to the barrel end of the hand held dryer in the use condition, the scented sheet is adapted to be vaporized by the means for heating discharged air while the hand held dryer is in the use condition and through the diffuser attached thereto.

17. The combination of claim 15, wherein the upper body and lower body are made of a rigid heat resistant elastomeric material.

* * * * *